United States Patent [19]

Hall, Jr. et al.

[11] Patent Number: 4,682,391

[45] Date of Patent: Jul. 28, 1987

[54] CABLE HARNESS ASSEMBLY APPARATUS

[75] Inventors: Leslie C. Hall, Jr., Camp Hill; David L. Meyer; Brian A. Wolfe, both of Jonestown, all of Pa.

[73] Assignee: AMP Incorporated, Harrisburg, Pa.

[21] Appl. No.: 768,078

[22] Filed: Aug. 21, 1985

[51] Int. Cl.[4] ..... H01R 43/04

[52] U.S. Cl. ..... 29/33 M; 29/564.6; 29/566.1; 29/749

[58] Field of Search ..... 29/33 K, 33 M, 564, 29/564.6, 566, 566.1, 566.2, 747, 566.3, 749

[56] References Cited

U.S. PATENT DOCUMENTS

| | | | |
|---|---|---|---|
| 4,148,130 | 4/1979 | Stauffer et al. | 29/566.3 |
| 4,332,083 | 6/1982 | Johnson, Jr. et al. | 29/749 |
| 4,359,257 | 11/1982 | Lopinski et al. | 339/99 R |
| 4,429,455 | 2/1984 | Roeker | 29/749 |
| 4,570,326 | 2/1986 | Meyer et al. | 29/566.3 |

*Primary Examiner*—Gil Weidenfeld

*Assistant Examiner*—Daniel W. Howell

*Attorney, Agent, or Firm*—F. Brice Faller; David L. Smith

[57] ABSTRACT

Cable harness manufacturing apparatus comprises a pair of rails defining a linear path through a workstation where a press terminates ribbon cable to connectors in connector receiving fixtures independently journaled to the rails. A first stop on the path positions connectors sequentially at the workstation while a series of second stops along the path downstream of the workstation act on the lead fixture to define the length of cable between pairs of connectors as well as triggering the press for sequential terminations of connectors in remaining fixtures. A cutter carriage journaled to the rails upstream of the workstation is spring loaded to urge remaining fixtures to the workstation. A third stop along the path downstream stops the lead fixture when it is desired to cut the cable, the cut end subsequently being drawn flushly into the last connector terminated.

21 Claims, 16 Drawing Figures

CABLE HARNESS ASSEMBLY APPARATUS

BACKGROUND OF THE INVENTION

The present invention relates to apparatus and method for applying insulation displacing electrical connectors to a ribbon cable.

Electrical connectors having insulation displacing terminals for application to ribbon cable are well known. U.S. Pat. No. 4,359,257, which is incorporated herein by reference, discloses such a connector, which is sold by AMP Incorporated under its AMP-LATCH trademark. Such connectors are conveniently handled in pre-assembled form, that is, the cover is latched to the connector allowing space to receive the cable so that termination is readily accomplished by pressing the connector and cover together. End terminations are readily achieved by bench apparatus such as that disclosed in U.S. Pat. No. 4,332,083. Apparatus for applying multiple connectors to a ribbon cable to manufacture a harness is disclosed in U.S. Pat. No. 4,148,130, but it is not automated and cannot handle pre-assembled connectors.

U.S. Pat. No. 4,570,326 discloses cable harness assembly apparatus for applying connectors having insulation displacing connectors to a ribbon cable. The apparatus is of the type comprising a workstation with a press having a termination ram and a plurality of connector receiving fixtures including a lead fixture which receives the connector to which the cable is first terminated. The fixtures are mounted to a frame at predetermined intervals, pre-assembled connectors are placed in the fixtures, and the cable is threaded through the connectors before advancing the frame through the workstation, stopping the fixtures sequentially thereat to terminate the cable to the connectors.

The prior art apparatus suffers the disadvantage of a long and cumbersome frame which is not readily adapted to automation, and further the requirement of fixtures having integral severing apparatus.

SUMMARY OF THE INVENTION

The present invention is characterized by rail means through the workstation and fixed relative thereto, the fixtures being independently journaled to the rail means for movement through the workstation from an upstream to a downstream side thereof. First stop means at the workstation is effective to stop the fixtures at the workstation sequentially as the fixtures are moved therethrough. Second stop means comprise a plurality of second stops along the rail means which cooperate with the lead fixture to stop it at predetermined intervals as it is moved downstream on the rail means. Upon aligning a ribbon cable with the connectors in the fixtures, terminating said cable to a connector in the lead fixture, temporarily releasing said first stop means, and moving said lead fixture downstream, said lead fixture will draw said cable through the workstation until the lead fixture hits a second stop.

The apparatus does not require a long and cumbersome frame and is readily adapted for automation, the second stop means being interlocked with the termination ram, which on the upstroke triggers the release of the first and second stop means to permit advance of the lead fixture. Additional or third stop means along the rail means are interlocked with cable cutting apparatus upstream of the workstation.

The automated embodiment of the invention disclosed herein requires only the following steps by the operator to manufacture a cable:

(1) Load connectors in fixtures downstream of workstation;

(2) Hit return button to move fixtures upstream of workstation;

(3) Turn crank on cable feed to thread cable through fixtures;

(4) Hit start button, which initiates harness manufacture (apparatus stops automatically when harness is complete);

(5) Remove completed harness.

DETAILED DESCRIPTION OF THE PREFERRED EMBODIMENT

Figure 1:
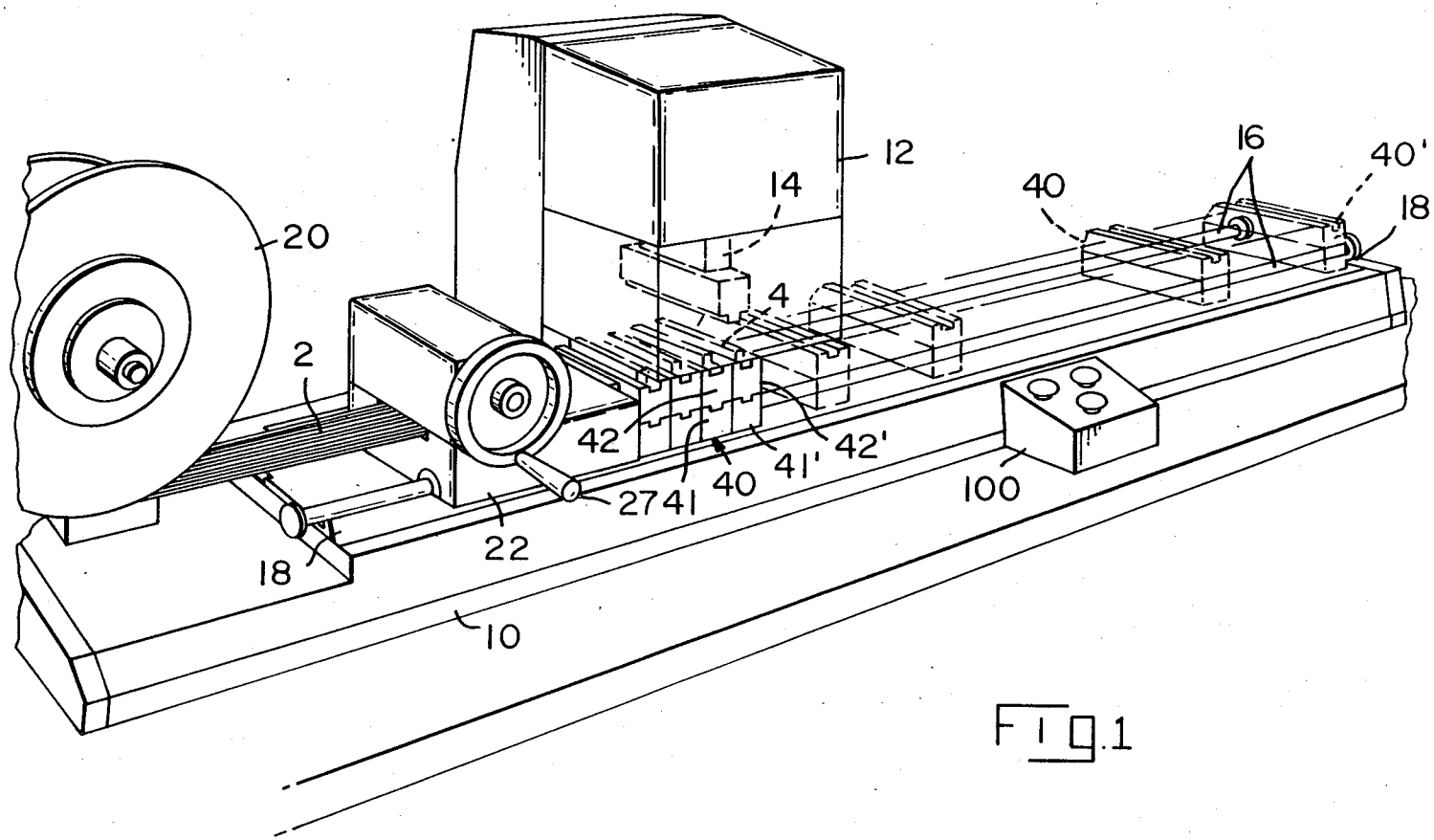
FIG. 1 is a perspective of the harness making apparatus.

Referring to FIG. 1, the cable making apparatus comprises a base 10 having mounted thereon a pair of cylindrical rails 16 supported by stanchions 18 and defining a linear path for cutter carriage 22 and connector receiving fixtures 40 journaled to the rails 16. The rails pass through a workstation beneath a press 12, where a vertically reciprocable termination ram 14 acts on a connector 4 nested in a fixture 40. Each connector receiving fixture 40 comprises a base 41 and a module 42, the lead fixture 40' comprising a base 41' and module 42' with minor differences as will be discussed. Ribbon cable 2 is supplied from a reel 20 mounted to the base 10 upstream of the workstation. A crank 27 on the cutter carriage 22 is used to initially feed the cable 2 through the carriage 22 and fixtures 40, which move downstream of the workstation sequentially as the terminations are completed.

Figure 2:
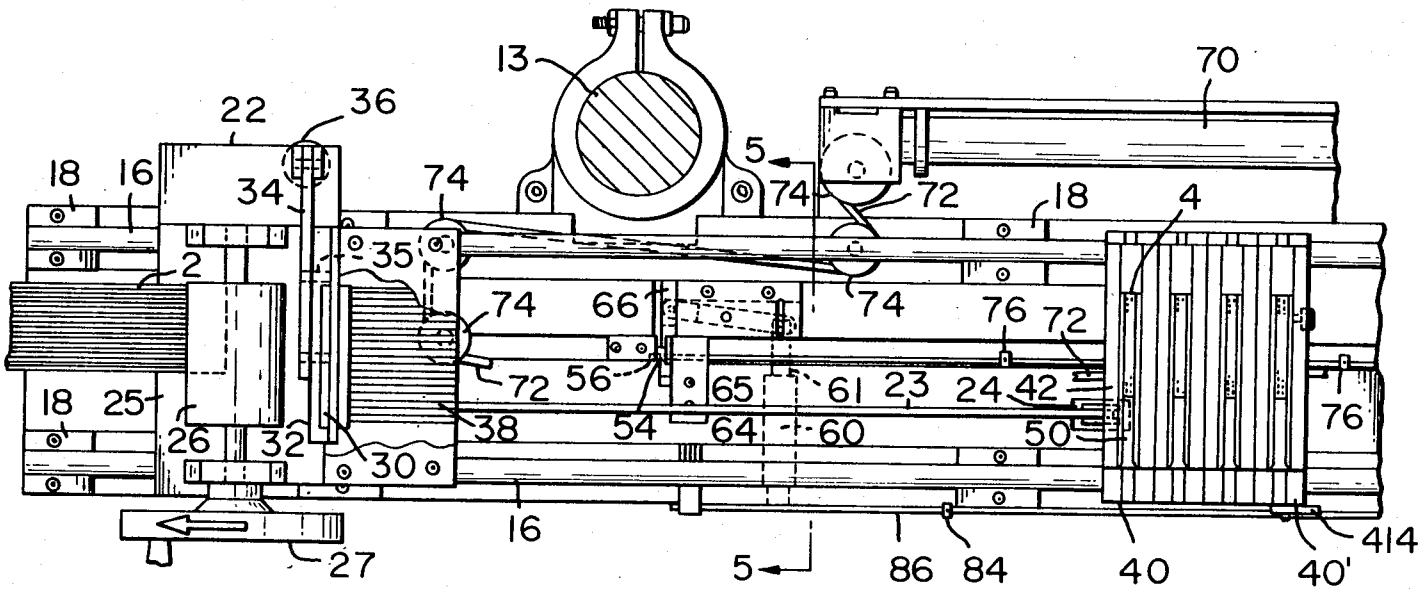
FIG. 2 is a plan view of the upstream end of the apparatus.
Figure 3:
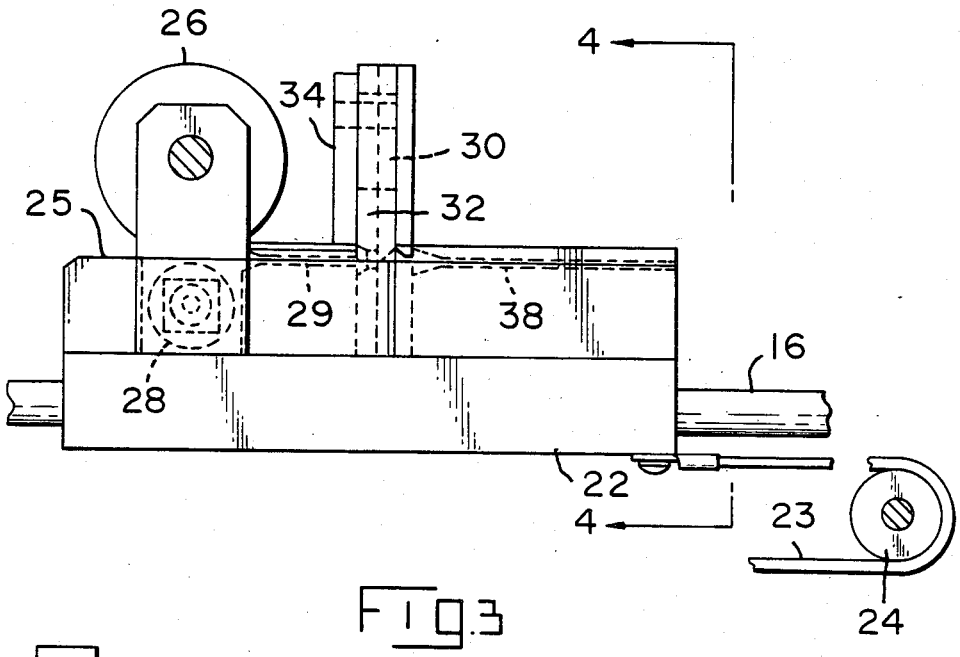
FIG. 3 is a side view of the cable feed and cutter carriage.
Figure 4:
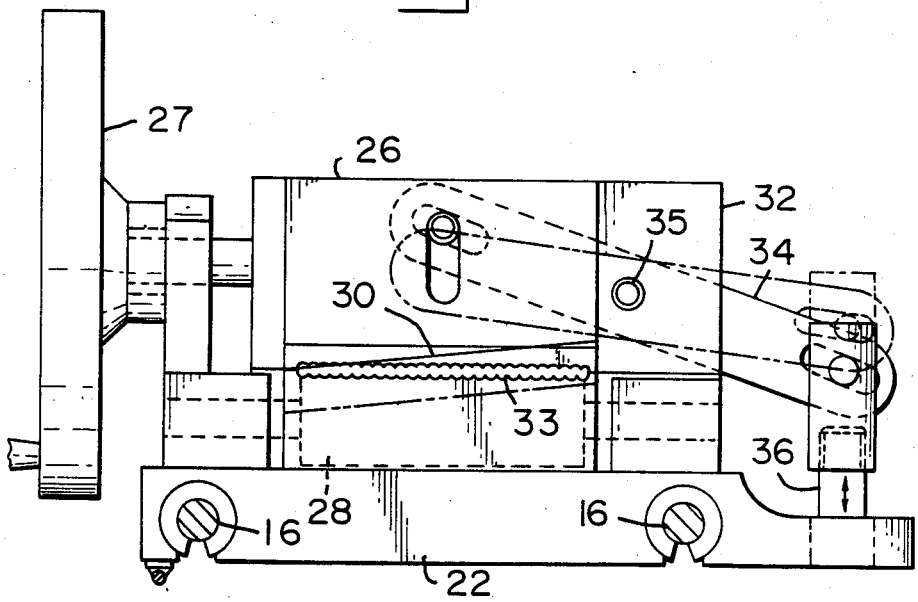
FIG. 4 is an end section of the carriage.

Referring to FIGS. 2, 3, and 4, the cable feed and cutter carriage 22 is journaled to rails 16 and urged resiliently downstream by cable 23 and a tension spring (not shown). The carriage 22 has first, second, and third fluted guide slots 25, 29, 38 therethrough which receive the cable 2, the fluting serving to laterally align the cable by cooperating with the ribbed cable surface. Feed rollers 26, 28 act on the cable 2 between first slot 25 and second slot 29, while cutting blade 30 acts on the cable between second slot 29 and third slot 38. The bottom roller 28 is an idler while the top roller 26 is driven by hand crank 27 to initially feed the ribbon cable 2 through guides 29, 38, fixtures 40, and connectors 4 therein when the fixtures 40 abut the carriage 22. The blade 30 is mounted in a vertical guide 32 having a cable slot 30 which provides an opposed shear edge. The blade 30 is driven vertically by pneumatically actuated rod 36 which pivots link 34 about pivot pin 35 fixed in guide 32. A pneumatic cylinder on the carriage is interlocked with a third stop 84 as will be described.

Figure 5:
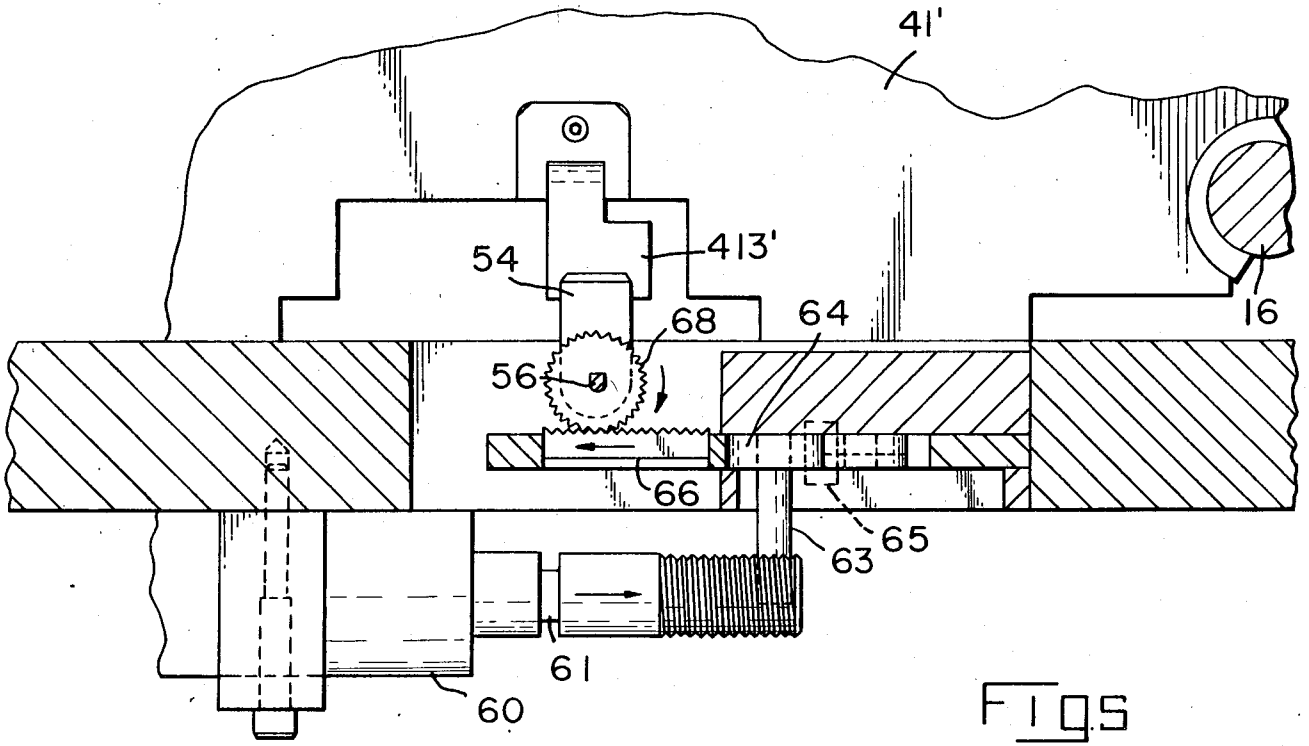
FIG. 5 is a section taken along line 5—5 of FIG. 2, showing the actuating mechanism for the first stop.

Referring to FIGS. 2 and 5, a first stop 54 serves to hold the connecting receiving fixtures 40 upstream of the workstation by interfering with extension 413', thus positioning the connector 4 in the lead fixture 40' at the workstation, which is aligned with the descent of the termination ram 14 adjacent press support 13 (the fixtures 40 are shown downstream in FIG. 2 for clarity). The stop 54 is released by actuating pneumatic cylinder 60, which drives rod 61 having pin 63 fixed vertically in the end thereof. This in turn pivots link 64 about fixed pin 65 to drive rack 66, thus rotating pin 68 which is keyed on the same shaft 56 as stop 54. Extensions 413, 413' are hinged to pass over stop 54 when the fixtures return.

Referring again to FIG. 2, salient features of the connector receiving fixtures 40 are the modules 42 having nests 50 therein which receive connectors 4 (references to fixtures 40 herein should be taken as referring to lead fixture 40' as well). The lead module 40' is moved upstream and downstream by pneumatic cable feed cylinder 70, which is pressurized on the right side of a piston thereon and bled on the left side to move fixture 40' downstream, and pressured on the left and bled on the right to return the fixture 40' upstream. This is accomplished by a cable 72 emerging from opposite ends of cylinders 70 through appropriate seals, the cable 72 traveling over pulleys 74 and being attached to lead fixture 40'. Second stops 76 are fixed to a shaft 78 by set screws at intervals determined by spacing between connectors in the finished cable. Third stops 84 are situated on shaft 86 outboard of and parallel to rails 16, however, only one stop 84 is set in the "up" position, to stop the lead fixture 40' when it is desired to cut cable 2 upstream of the fixtures remaining between carriage 22 and the workstation.

Figure 6:
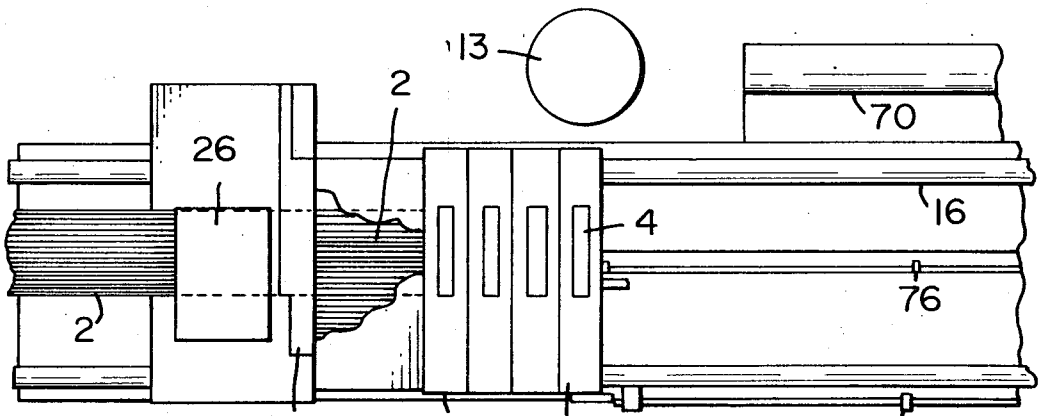
FIGS. 6–10 are partial plan schematic views showing the sequence of harness manufacture.

FIGS. 6, 7, 8, 9 and 10 depict the sequence of operations in the manufacture of a four connector flat cable harness. Referring first to FIG. 6, the fixtures 40, 40' are drawn upstream by action of cylinder 70 after the operator loads connectors 4 therein and hits the return button on control box 100 (FIG. 1). The connector receiving fixtures 40, 40' are loaded against first stop 54 by the action of cable 23 and pulley 24 (FIG. 3), which urges carriage 22 in a downstream direction. The cable 23 is drawn upstream by a tension spring (not shown) fixed upstream of carriage 22. The cable 2 is then fed through individual connectors 4 in nests 50 by turning crank 27. The start button on control box 100 (FIG. 1) is depressed to commence automatic cycling, which begins with descent of the terminating ram 14 (FIGS. 1, 13–17). As the ram 14 returns upward after terminating the cable, first stop 54 is rotated very briefly through ninety degrees, permitting the lead fixture 40' to pass. The stop 54 begins its return before the fixture 40' is clear, thus assuring it will intercept the next fixture 40. While the stop 54 is down, the cable feed cylinder 70 is actuated to begin pulling the lead fixture 40' downstream.

Figure 7:
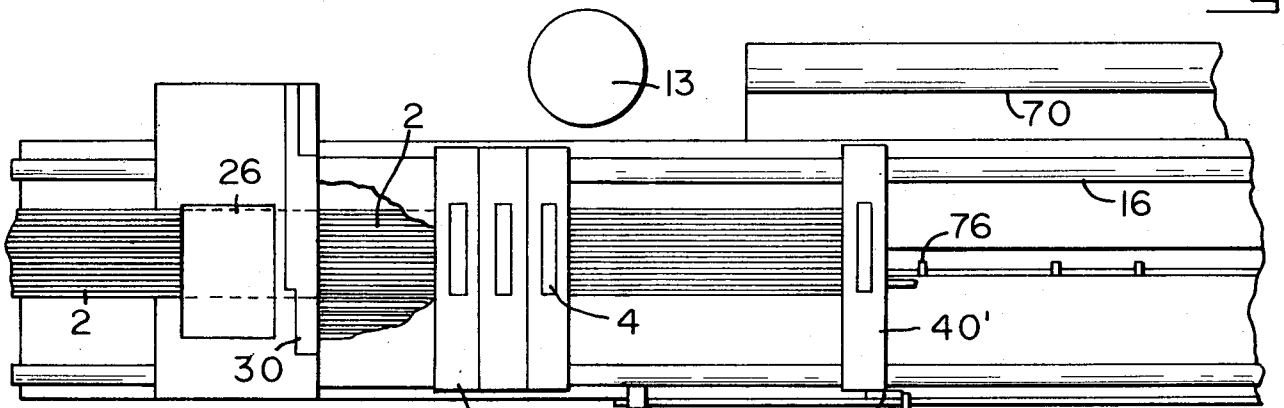

FIG. 7 shows the lead fixture 40' with hinged extension 414 butted against stop 84, which moves shaft 86 an axial increment to actuate a switch 88 (FIG. 11), which triggers the pneumatic cylinder controlling the severing blade 30. The position of stop 84 is determined by the location of the last secondary stop 76 (FIG. 10), so that the cut cable 2 will be drawn flushly into the last connector 4 in the harness. Once the cable 2 is cut, the stop 84 is roated through ninety degrees and the lead fixture 40' is drawn further downstream by leftward movement of the piston in pneumatic cylinder 70. Note well that the stop 54 is not released during the release of stop 84. The release of stop 84 is mechanically synchronized with secondary stops 76, and thus is released only briefly so that the next stop 76 will be in position to stop fixture 40 as shown in FIG. 8.

Figure 8:
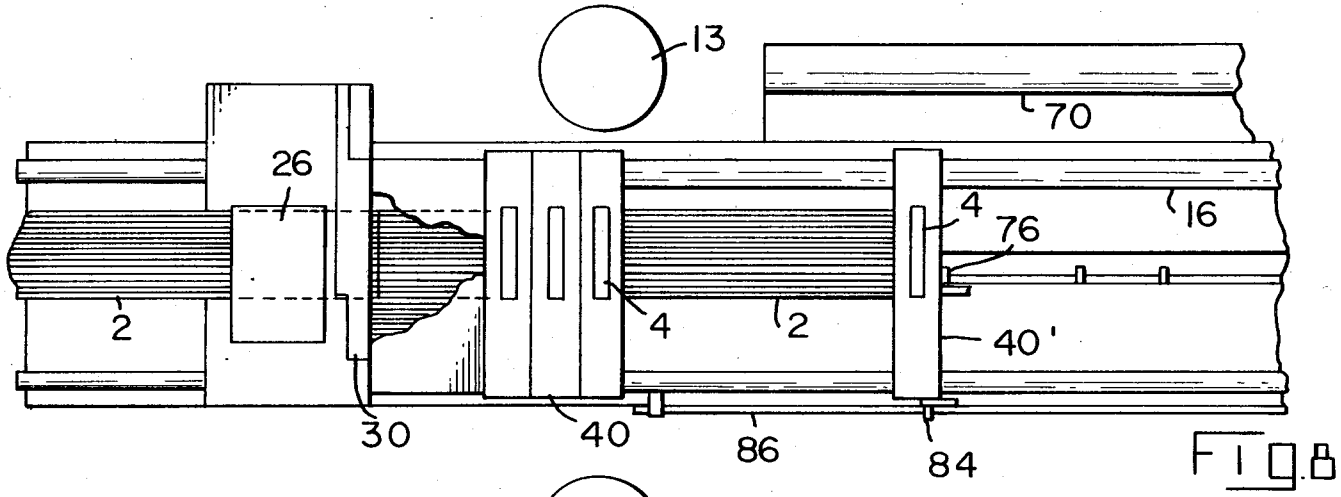
Figure 9:
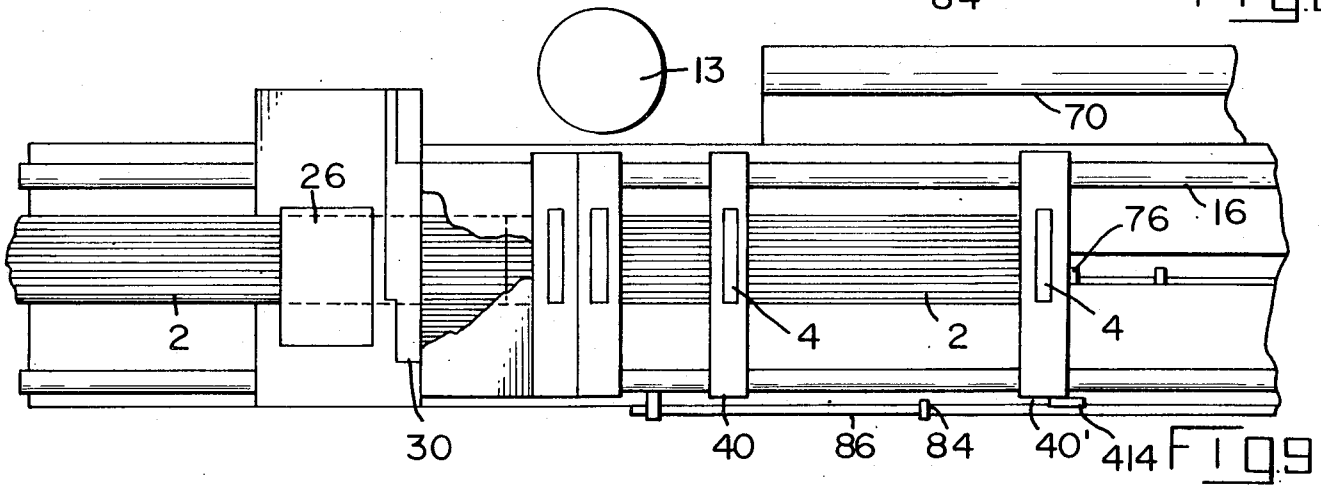
Figure 10:
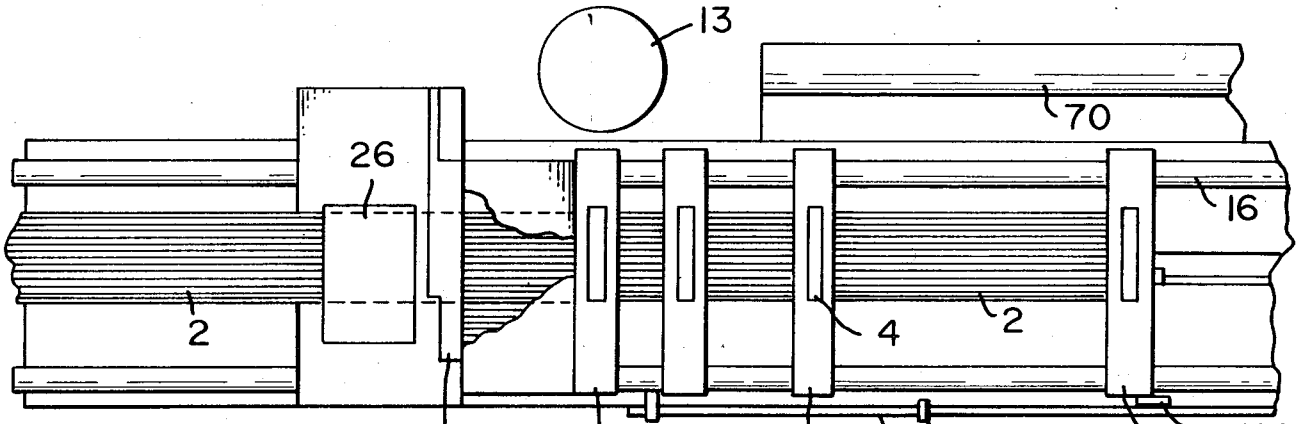

Referring to FIG. 8, the shaft 78, like shaft 86, is provided with limited end float and acts on a switch 80 (FIG. 11) which triggers the press. As the ram returns, stops 54, 76 are released simultaneously by actuating cylinders 60, 90 (FIGS. 2, 5, 11, 12) simultaneously. The fixture 40' is then drawn by cable 72 until it hits the next stop 76, as shown in FIG. 9, drawing the pre-cut cable 2 through the connectors 4 in the third and fourth fixtures 40. The stops 54, 76 are again simultaneously but briefly released so that the last fixture 40 moves to the workstation and the lead fixture 40' hits the last secondary stop 76, as shown in FIG. 10. This triggers the press for the final termination.

Figure 11:
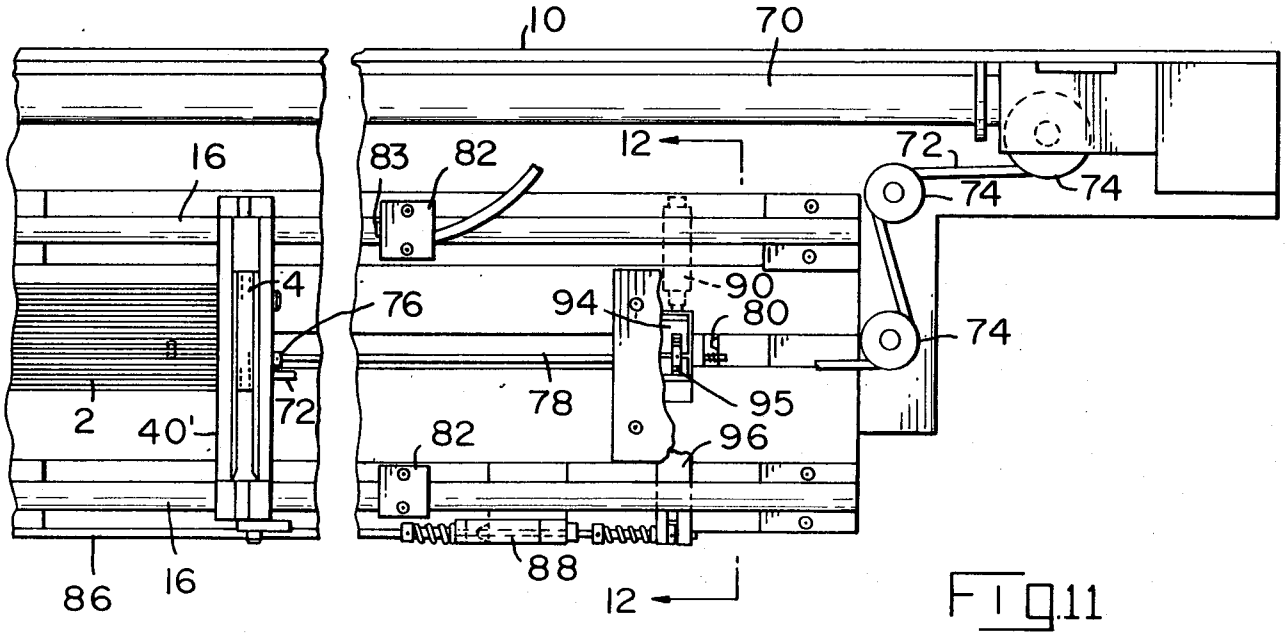
FIG. 11 is a plan view of the downstream end of the apparatus.

FIG. 11 shows the downstream end of the apparatus when the harness is in the position of FIG. 10. After stops 54, 76 are released a final time, the cable cylinder 70 pulls the lead fixture downstream until it hits end stops 82, actuating a switch 83 which ends automatic operation. The operator then removes the completed harness, reloads fixtures 40, 40' with connectors, and hits the return switch to return the fixtures to the position of FIG. 6. The extensions 413, 413', 414 (FIGS. 5, 13, 15) are hinged to swing over stops 54, 76, 84 as the fixtures move upstream. Note that stops 76 are not as high as stops 54, while the stop 413' on the lead fixture 40' (FIG. 3) extends lower than succeeding stops 413. This permits the fixtures 40 following the lead fixture 40' to pass freely over second stops 76.

Figure 12:
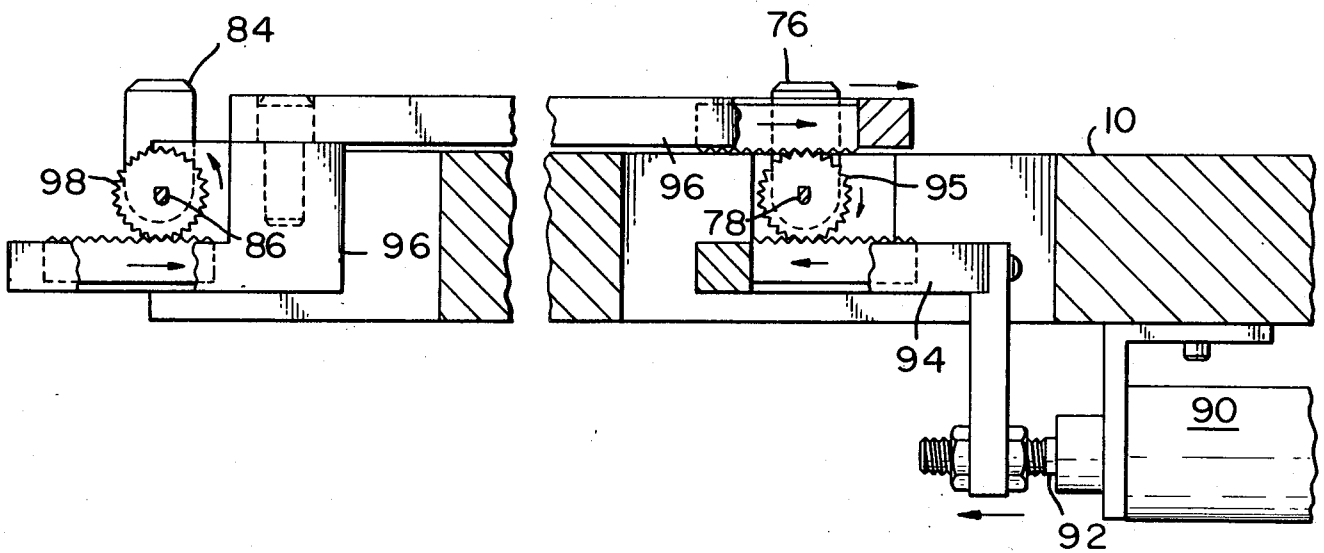
FIG. 12 is a section taken along line 12—12 of FIG. 11 showing the actuating mechanism for the second and third stops.

Referring to FIGS. 11 and 12, the second stop shaft 78 and third stop shaft 86 are rotated simultaneously to release the stops 76, 84 thereon by a single action of pneumatic cylinder 90. This pushes rod 92, which is adjustably fixed to inboard rack 94, which in turn rotates second pinion 95 which is keyed on second shaft 78, as are stops 76. Clockwise rotation of second pinion 95 effects rightward movement of transverse rack 96, which in turn causes counter clockwise rotation of third pinion 98, which is keyed on shaft 86, as are stops 84. Note that this drive arrangement permits the axial float of shafts 78, 86 which is necessary to activate respective sensors 80, 88.

Often, cable harnesses having multiple connectors as herein concerned require that the connectors have different orientations, i.e., that the mating faces face oppositely from the plane of the cable. This problem is addressed by providing two types of connector receiving modules for the fixtures 40.

Figure 13:
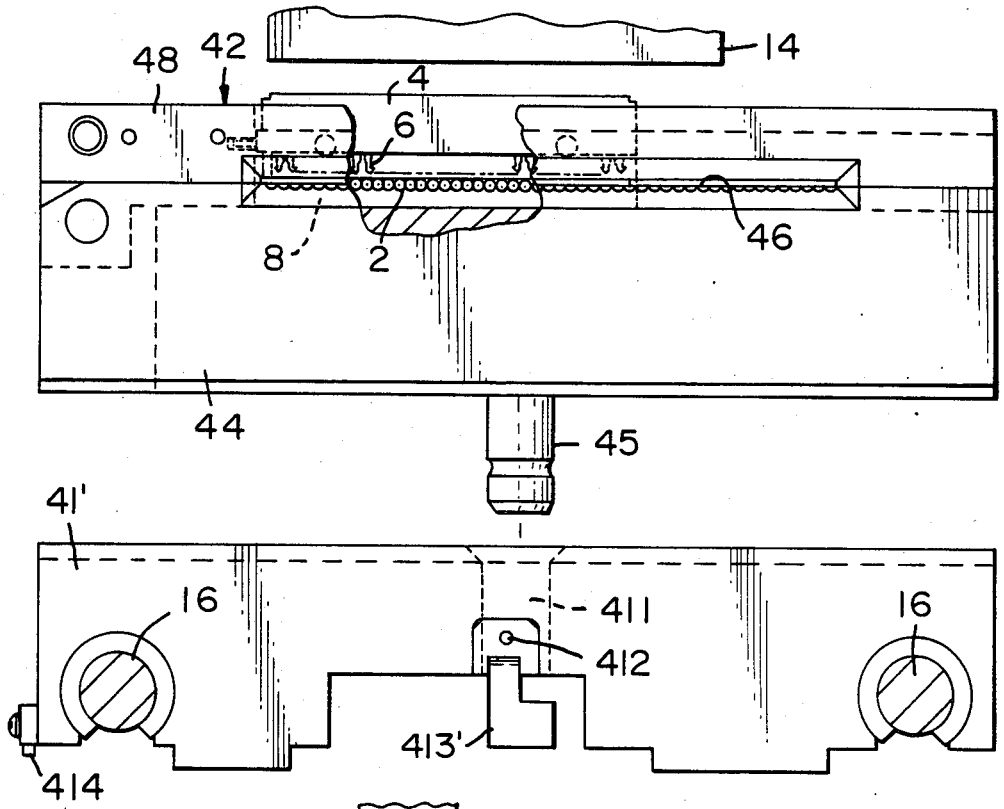
FIG. 13 is a side view of a module for receiving a connector with the mating face up.
Figure 14:
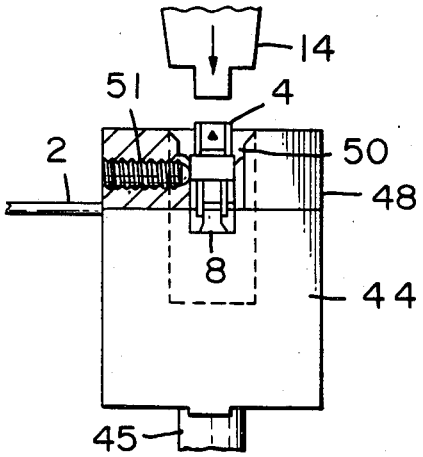
FIG. 14 is an end view of a module for receiving a connector with the mating face up.

FIGS. 13 and 14 show the module 42 for a "mating face up" orientation. The module 42 comprises a bottom portion 44 having a key 45 received in bore 411 of a base 41 or 41', a spring loaded detent 412 providing retention. The base 41' is identical to succeeding bases 41, except for extension 413' being longer so as to intercept the second stops 76, and further having side extension 414. The module 42 further comprises a top portion 48 fixed to bottom portion 44, the ribbon cable 2 being received therebetween against fluted surface 46 on bottom portion 44. The module has a nest 50 which receives the connector 4 with the mating side up and the exposed slotted plate portions of terminals 6 facing down. A cover 8 pre-assembled to the connector 4 is received in the bottom of the nest 50. A spring loaded detent 51 holds the connector 4 in position, and the cable 2 is threaded through the fixture between the connector 4 and the cover 8. The lead fixture 40' differs from other fixtures 40 only by having means in the module 42 for stopping the end of cable 2 flush with the side of the connector. The cable is terminated by descent of ram 14, which acts directly on connector 4 to push it down onto the cable 2. Note that nest 50 is considerably longer than the connector 4 shown therein. The fluted surface 46 is likewise capable of receiving a wider cable 2. Thus longer connectors may be terminated to wider cable, having up to sixty-four conductors. Shorter connectors and narrower cable may also be terminated. Regardless of the size of connector and cable being terminated, the connectors will have a common datum point, which is the end of the nest (shown on the left in FIG. 13).

Figure 15:
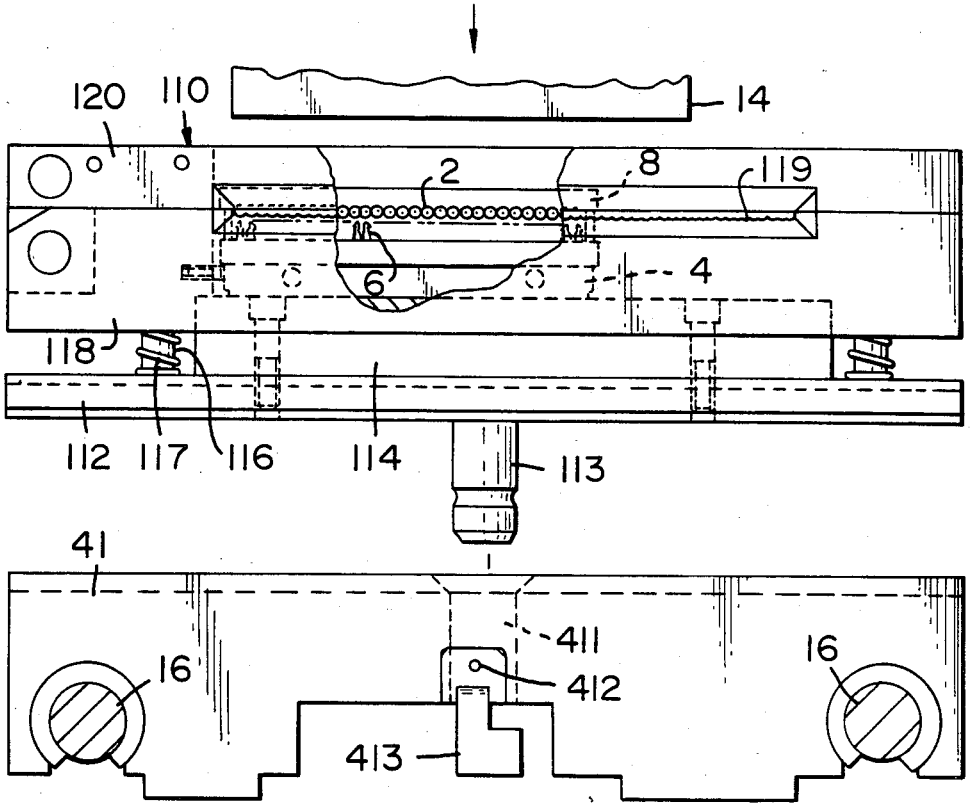
FIG. 15 is a side view of a module for receiving a connector with the mating face down.
Figure 16:
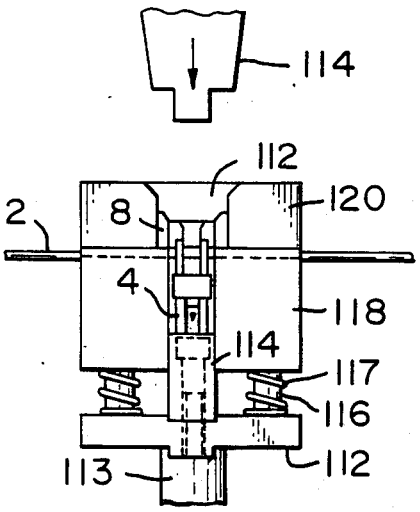
FIG. 16 is an end view of a module for receiving a connector with the mating face down.

FIGS. 15 and 16 show the module 110 for the "mating face down" orientation, where the cable 2 and cover 8 must be forced down onto terminals 6 of connector 4. The module 110 comprises a bottom portion 112 having a key 113 for fixing it to a base 41 (FIG. 1), an intermediate portion 118 mounted for lost motion by shafts 116 fixed in bottom portion 112, and springs 117 serving to return the portion 118. A top portion 120 is fixed to intermediate portion 118, the ribbon cable 2 being received therebetween on fluted surface 119. All fluted surfaces 46, 119 are in the same plane when the cable 2 is fed through the modules 42, 110. The ram 14 partially enters nest 112 and bears on both the top portion 120 and cover 8 to force the cable 2 down onto terminals 6, the connector 4 sitting in nest on anvil 114, which does not move down. After termination, the cable 2 returns upward to the position shown in FIG. 15, drawing the connector 4 with it and off of anvil 114.

The foregoing is exemplary and not intended to limit the scope of the claims which follow.

We claim:

1. Cable harness assembly apparatus for applying a plurality of connectors having insulation displacing terminals to a ribbon cable, said apparatus being of the type comprising a workstation with a press having a termination ram and a plurality of connector receiving fixtures including a lead fixture which receives the connector to which the cable is first terminated, said apparatus further comprising:

rail means through said workstation and fixed relative thereto, said fixtures being independently journaled to said rail means for movement through said workstation from an upstream to a downstream side thereof, first stop means at said workstation, said first stop means being effective to stop said fixtures at said workstation sequentially as said fixtures are moved therethrough, means for moving said lead fixture downstream, second stop means for stopping said lead fixture at predetermined intervals as it is moved downstream, whereby, upon aligning a ribbon cable with the connectors in the fixtures, terminating said cable to a connector in the lead fixture, temporarily releasing said first stop means, and moving said lead fixture downstream, said lead fixture will draw said cable through the workstation until the lead fixture is stopped.

2. Apparatus as in claim 1 wherein said second stop means comprises a series of second stops located at predetermined intervals along said rail means.

3. Apparatus as in claim 2 wherein said second stops are fixed to a common shaft.

4. Apparatus as in claim 3 wherein said shaft is provided with end float and bears axially on switch means which activates said press when said lead fixture hits a second stop.

5. Apparatus as in claim 3 further comprising means to rotate the shaft, whereby when the shaft is rotated said second stops are rotated out of the path of the lead fixture thereby permitting the lead fixture to pass.

6. Apparatus as in claim 2 wherein said second stops are interlocked with said press to activate said termination ram when said lead fixture hits a second stop.

7. Apparatus as in claim 2 further comprising means for synchronizing the release of the second stop means with the release of the first stop means.

8. Apparatus as in claim 1 further comprising cable cutting means on the upstream side of said workstation.

9. Apparatus as in claim 8 wherein said cable cutting means is mounted on a carriage journaled to said rail means.

10. Apparatus as in claim 9 wherein said carriage is spring loaded toward said workstation to urge said fixtures theretoward.

11. Apparatus as in claim 8 further comprising third stop means parallel to said rail means, said third stop means being cooperable with said lead fixture to stop it as it is moved on said rail means, said third stop means being interlocked with said cable cutting means.

12. Apparatus as in claim 11 wherein said third stop means comprises a stop fixed to a shaft having limited end float, said shaft bearing axially on switch means which activates said cutting means when the lead fixture hits said stop.

13. Apparatus as in claim 1 further comprising means for urging said fixtures toward said workstation from the upstream side thereof.

14. A method for manufacturing a cable harness having a plurality of insulation displacing connectors on a ribbon cable comprising the following steps:

loading said connectors into respective connector receiving fixtures on a linear path passing through a workstation from an upstream side to a downstream side, said fixtures being free to move relative to each other on said linear path, locating the fixtures adjacent each other on the upstream side of the workstation with a lead fixture being located at the workstation, threading said ribbon cable through the connectors in said adjacent fixtures so that the conductors in the cable are aligned with terminals in the connectors, terminating the cable to the connector in the lead fixture at the workstation, advancing the lead fixture to a predetermined point downstream, the lead fixture drawing said ribbon cable through the workstation, advancing the next fixture to the workstation, whereby when the next fixture is advanced to the workstation and the lead fixture is advanced to a predetermined point downstream, the lead fixture draws the ribbon cable through the connector in the next fixture to the appropriate location for terminating the connector in the next fixture on the ribbon cable at the workstation.

15. The method of claim 14 wherein the fixtures are juxtaposed on the upstream side of the workstation, the fixtures on the upstream side moving as a unit when the next fixture is advanced to the workstation.

16. The method of claim 14 wherein the cable is drawn from a substantially endless source upstream of the fixtures on said linear path.

17. The method of claim 16 wherein the cable is cut upstream of the fixtures when the lead fixture is advanced to a predetermined point downstream of the workstation.

18. The method of claim 14 comprising the further steps of:

terminating the cable to the connector in the next fixture at the workstation, advancing the lead fixture to a further predetermined point downstream, the lead fixture drawing the ribbon cable and the next fixture as a unit.

19. A method for manufacturing a cable harness having a plurality of insulation displacing connectors at predetermined positions on a ribbon cable, comprising the steps of:

(a) loading said connectors into respective connector receiving fixtures on a linear path passing through a workstation from an upstream side to a downstream side, said fixtures being free to move along said linear path relative to each other;

(b) stacking the fixtures adjacent each other on the linear path on the upstream side of the workstation with a lead fixture being located at the work station;

(c) threading said ribbon cable through the connectors in said adjacent fixtures so that the conductors in the cable are aligned with terminals in the connectors;

(d) terminating the ribbon cable to the connector in the lead fixture at the workstation;

(e) advancing the lead fixture to the next subsequent predetermined point downstream of the workstation;

(f) advancing the next fixture containing an unterminated connector to the workstation;

(g) drawing the ribbon cable through all of the stacked, unterminated connectors while the lead fixture is being advanced;

(h) terminating the cable to the connector in the fixture at the workstation; and (i) repeating steps (e) through (h) as required.

20. The method of manufacturing a cable as recited in claim 19 further comprising the steps of:

stopping the lead fixture at a predetermined cable cutting position downstream of the workstation; and cutting the ribbon cable upstream of the workstation.

21. The method of manufacturing a cable as recited in claim 20 wherein cutting the ribbon cable upstream of the workstation further comprises cutting the ribbon cable upstream of the stacked fixtures holding unterminated connectors.

* * * * *